US006945528B2

(12) United States Patent
Nakamura

(10) Patent No.: US 6,945,528 B2
(45) Date of Patent: Sep. 20, 2005

(54) SHEET FEEDING APPARATUS AND IMAGE FORMING APPARATUS

(75) Inventor: Takao Nakamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/137,373

(22) Filed: May 3, 2002

(65) Prior Publication Data

US 2002/0167125 A1 Nov. 14, 2002

(30) Foreign Application Priority Data

May 10, 2001 (JP) ..... 2001/139978

(51) Int. Cl.[7] ..... B65H 1/00

(52) U.S. Cl. ..... 271/171; 271/117; 271/127; 271/253; 271/241

(58) Field of Search ..... 271/171, 236, 271/248, 253, 241, 127, 117

(56) References Cited

U.S. PATENT DOCUMENTS

| | | | | | |
|---|---|---|---|---|---|
| 4,457,507 | A | * | 7/1984 | Ishikawa et al. | 271/121 |
| 4,529,189 | A | * | 7/1985 | Konishi et al. | 271/22 |
| 4,838,535 | A | * | 6/1989 | Yokoi et al. | 271/22 |
| 4,966,358 | A | * | 10/1990 | Yokoi et al. | 271/10.11 |
| 4,978,112 | A | * | 12/1990 | Yokoi | 271/9.02 |
| 5,118,090 | A | * | 6/1992 | Sonoda et al. | 271/10.13 |
| 5,348,283 | A | * | 9/1994 | Yanagi et al. | 271/127 |
| 5,391,450 | A | | 2/1995 | Nagatsuka et al. | 430/99 |
| 5,411,248 | A | * | 5/1995 | Yamaguchi | 271/171 |
| 5,437,444 | A | * | 8/1995 | Kawakami et al. | 271/22 |
| 5,725,319 | A | * | 3/1998 | Saito et al. | 400/629 |
| 5,938,190 | A | * | 8/1999 | Campbell et al. | 271/171 |
| 6,050,563 | A | * | 4/2000 | Vedoy et al. | 271/10.07 |
| 6,056,286 | A | * | 5/2000 | Koga | 271/145 |
| 6,152,440 | A | * | 11/2000 | Yip et al. | 271/9.11 |
| 6,170,817 | B1 | * | 1/2001 | Kawaguchi | 271/167 |
| 6,206,367 | B1 | * | 3/2001 | Jo | 271/264 |
| 6,416,050 | B1 | * | 7/2002 | Niikura | 271/127 |
| 6,547,237 | B2 | * | 4/2003 | Sugino et al. | 271/119 |

FOREIGN PATENT DOCUMENTS

| | | | | | |
|---|---|---|---|---|---|
| EP | 525746 | A1 | * | 2/1993 | B65H/1/12 |
| JP | 57107346 | A | * | 7/1982 | B65H/3/56 |
| JP | 01081721 | A | * | 3/1989 | B65H/1/04 |
| JP | 01162640 | A | * | 6/1989 | B65H/3/06 |
| JP | 03195635 | A | * | 8/1991 | B65H/1/04 |
| JP | 06191650 | A | * | 7/1994 | B65H/1/04 |
| JP | 06234437 | A | * | 8/1994 | B65H/3/52 |

* cited by examiner

*Primary Examiner*—Kathy Matecki
*Assistant Examiner*—Matthew J. Kohner
(74) *Attorney, Agent, or Firm*—Fitzpatrick, Cella, Harper & Scinto

(57) ABSTRACT

A sheet feeding apparatus includes a sheet stacking unit, sheet feeding unit, and a sheet support member. Sheets are stacked on the sheet stacking unit. The sheet feeding unit is placed to be movable in the widthwise direction of the sheets stacked on the sheet stacking unit and feeds the sheets stacked on the sheet stacking unit. The sheet support member is placed at a position different from the position of the sheet feeding unit within an area where the sheet feeding unit can move, and supports the sheets stacked on the sheet stacking unit. The sheet support member can move in the widthwise direction of the sheet independently of the sheet feeding unit.

8 Claims, 15 Drawing Sheets

SHEET FEEDING APPARATUS AND IMAGE FORMING APPARATUS

BACKGROUND OF THE INVENTION

1. Field of the Invention

The present invention relates to a sheet feeding apparatus for feeding a sheet, e.g., a recording sheet, to an image forming apparatus or the like, and an image forming apparatus having the sheet feeding apparatus.

2. Related Background Art

FIG. 15 is a perspective view showing the schematic arrangement of a conventional sheet feeding apparatus.

As shown in FIG. 15, the conventional image forming apparatus such as a printer has a sheet feeding apparatus 121 for feeding sheets one by one to an image forming unit such as a recording unit (or printing unit). In such a sheet feeding apparatus, a feed roller 102 is brought into pressure-contact with a sheet to provide a convey force, and a separation means constituted by a separation pad, separation pawl, separation bank, and the like is used to provide a convey load, thereby separating only one sheet from the second and subsequent sheets.

As shown in FIG. 15, the sheet feeding apparatus 121 having such a separation means includes a roller shaft 131 pivotally supported on a base 140, feed roller units 130 and 130' inserted in the roller shaft 131, and a hopper 103 which is pivotally mounted on the base 140 and comes into contact with/separates from the feed roller 102. A side guide 132 is mounted on the hopper 103. The side guide 132 can move in the sheet widthwise direction in accordance with the width of a sheet bundle stacked on the hopper 103.

The second feed roller unit 130' moves together with the slidable side guide 132. The position of the first feed roller unit 130 is fixed.

Such a sheet feeding apparatus requires a space in which the second feed roller unit 130' moves. When a wide sheet bundle such as an A3-size sheet bundle is stacked, in particular, it is difficult to ensure a sufficient support area for the leading edge middle portion of a sheet bundle in the hopper 103. As shown in FIG. 15, therefore, the hopper 103 has a rotating support member 150, in the space in which the second feed roller unit 130' moves, to support the leading edge middle portion of a sheet bundle.

With this arrangement, when the side guide 132 is aligned with a wide sheet, the leading edge middle portion of the sheet is supported by the rotating support member 150. In addition, when the hopper 103 so pivots as to come into pressure-contact with the feed roller 102 in feeding operation, the leading edge middle portion of the sheet bundle is supported by the rotating support member 150. When the side guide 132 is aligned with a narrow sheet, the rotating support member 150 comes into contact with the second feed roller unit 130' and pivots about a shaft 150*a* in a direction S in FIG. 15 to be accommodated in the hopper 103. This makes it possible to ensure a space in which the second feed roller unit 130' moves.

The rotating support member 150, however, only supports the leading edge middle portion of a sheet bundle in an auxiliary manner. For this reason, the state of the leading edge of a sheet that is separated after feeding operation becomes unstable because convey routes are different between the two ends and the middle portion in the sheet widthwise direction. As a consequence, the sheet may skew and be conveyed to a wrong position.

When the side guide 132 is aligned with a narrow sheet, since the sheet bundle tends to be caught in the recess portion where the rotating support member 150 is housed, the sheet bundle is reluctant to be stacked in the hopper 103.

SUMMARY OF THE INVENTION

It is an object of the present invention to provide a sheet feeding apparatus which can properly support sheets throughout the entire width of the sheets and prevent occurrence of a sheet feed failure.

It is another object of the present invention to provide a sheet feeding apparatus comprising sheet stacking means on which a sheet is stacked, sheet feeding means which is placed to be movable in a widthwise direction of the sheet stacked on the sheet stacking means and feeds the sheet stacked on the sheet stacking means, and a sheet support member which is placed at a position different from a position of the sheet feeding means within an area where the sheet feeding means can move, and supports the sheet stacked on the sheet stacking means, wherein the sheet support member can move in the widthwise direction of the sheet independently of the sheet feeding means.

DETAILED DESCRIPTION OF THE PREFERRED EMBODIMENTS

The embodiments of the present invention will be described below with reference to the accompanying drawings.

(First Embodiment)

Figure 1:
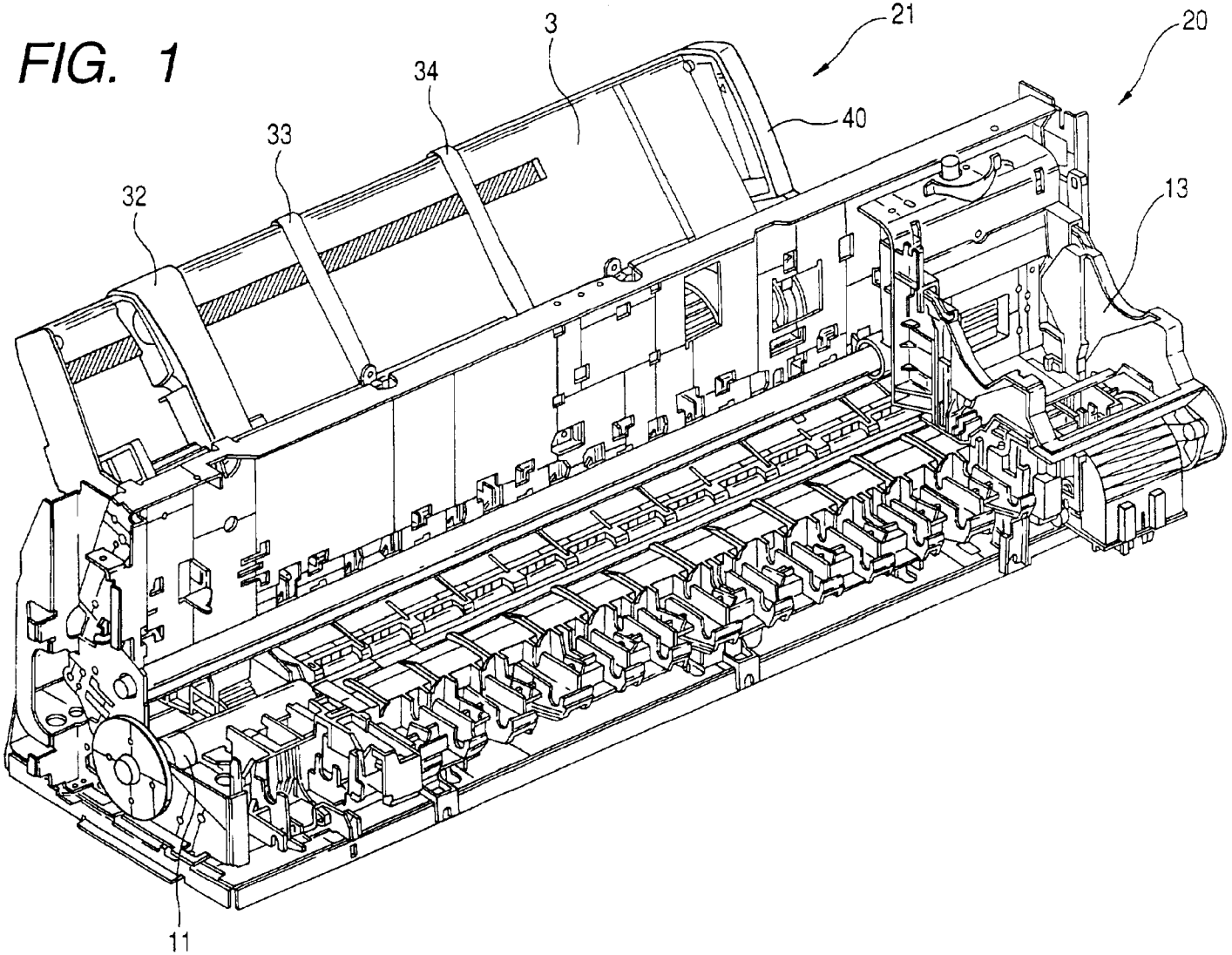
FIG. 1 is a perspective view showing the overall schematic arrangement of a printer apparatus as an image forming apparatus according to the first embodiment of the present invention.
Figure 2:
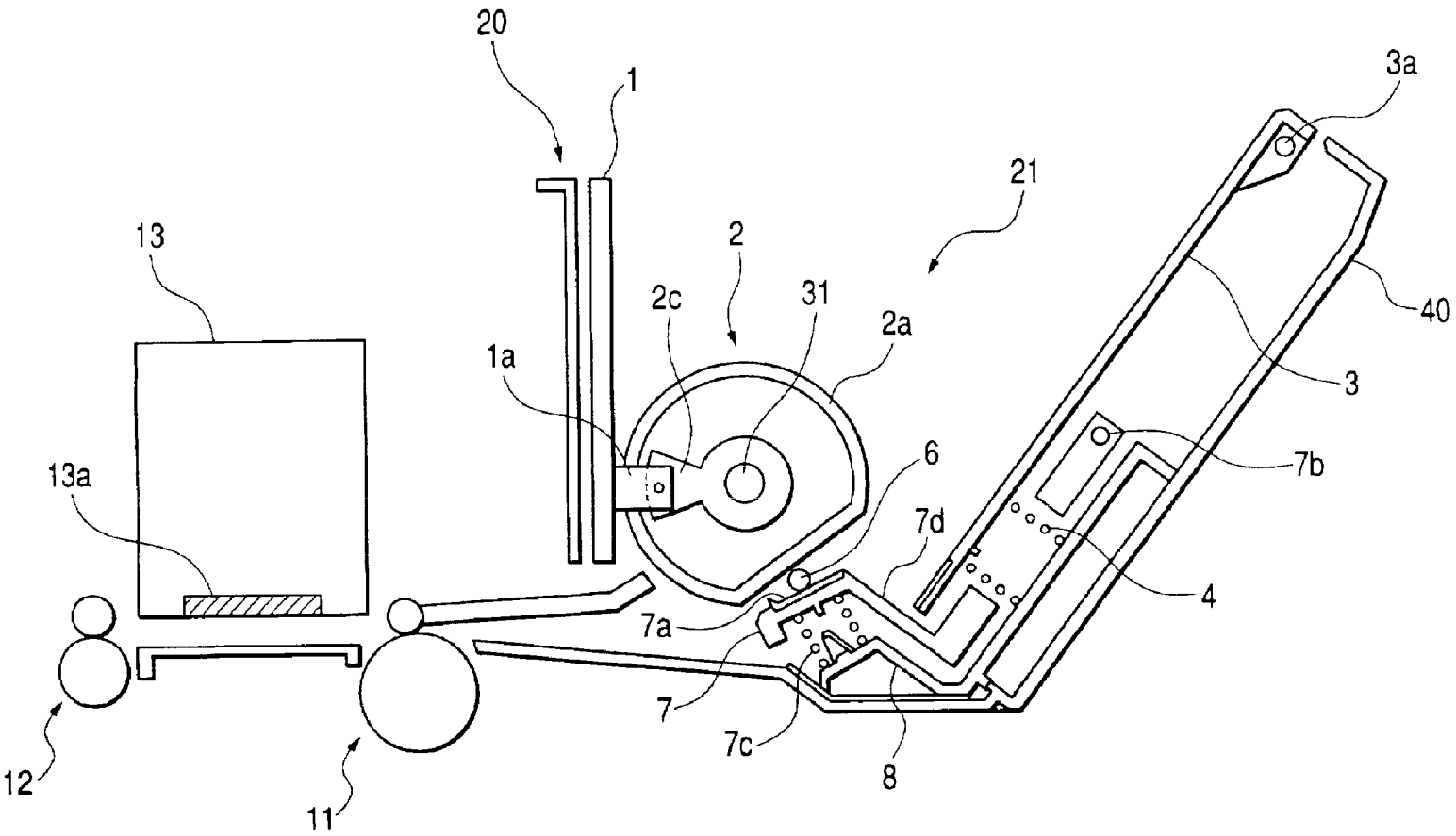
FIG. 2 is a sectional view of the printer apparatus in FIG. 1.
Figure 3:
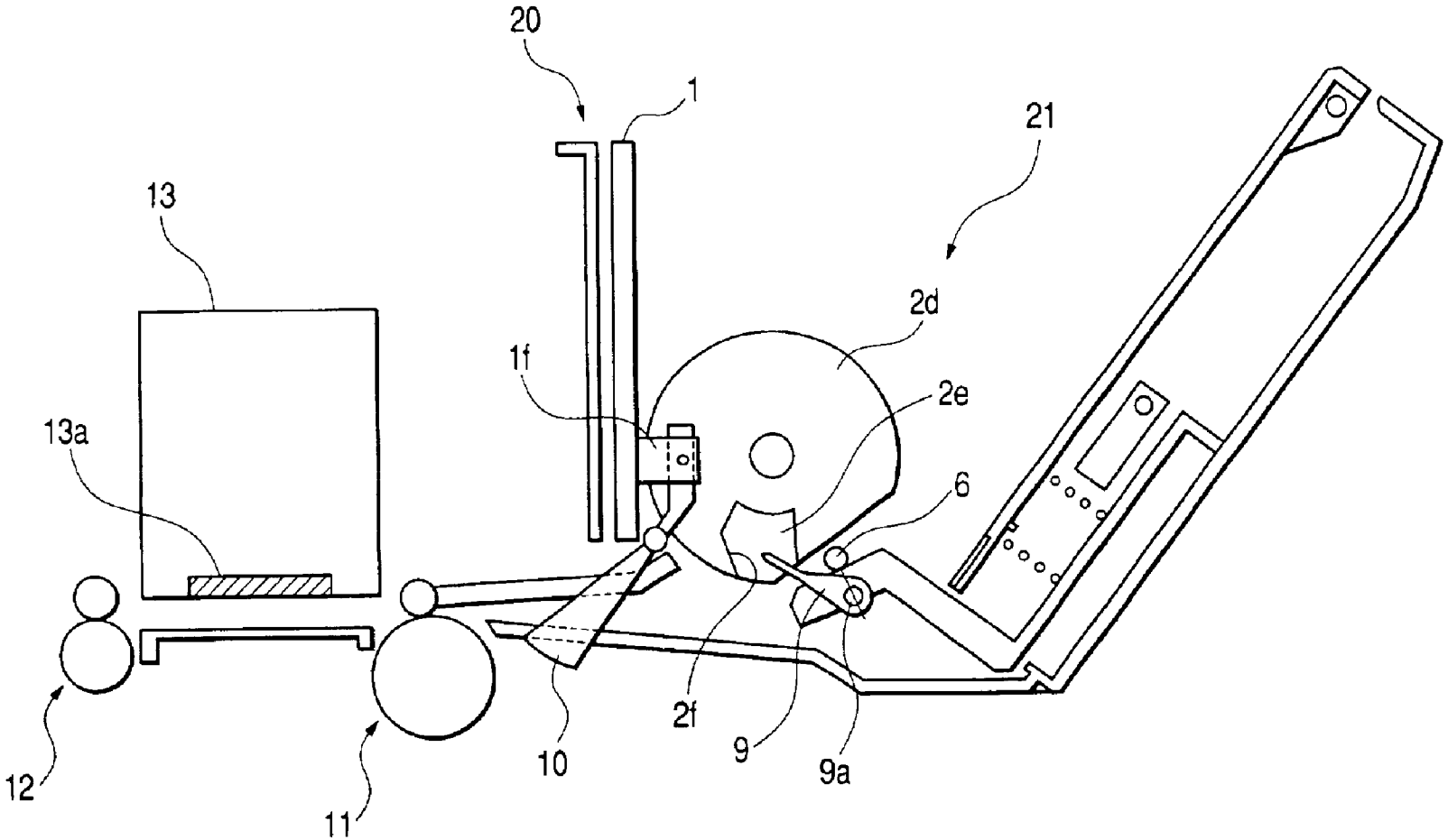
FIG. 3 is a sectional view of the printer apparatus in FIG. 1.

FIG. 1 is a perspective view showing the overall schematic arrangement of a printer apparatus as an example of an image forming apparatus according to the first embodiment of the present invention. FIG. 2 is a sectional view of the printer apparatus in FIG. 1. FIG. 3 is a sectional view of the printer apparatus in FIG. 1.

Referring to FIG. 2, a printer apparatus 20 includes a recording head unit 13 serving as an image forming portion on which a recording head 13*a* is mounted, a sheet feeding apparatus 21 for feeding a sheet (not shown) to the recording head unit 13, a main board 1 for controlling the overall printer apparatus 20, and the like.

In this case, the sheet feeding apparatus 21 includes a semicircular feed roller 2 serving as a sheet feeding means for feeding sheets stacked on a sheet stacking means (not shown), a hopper 3 serving as a sheet pressing/separating means which is mounted at the sheet-feed-side end portion of the sheet stacking means and presses/separates a sheet against/from the feed roller 2, and a separation pad portion 7 having a separation pad 7*a* serving as a separation means for separating the sheet fed by the feed roller 2.

Note that the feed roller 2 has a roller rubber 2*a* that comes into contact with the surface of a sheet, and a groove so as to be fitted on a roller shaft 31 as a rotation center and rotate together. The roller shaft 31 has a long projection rib in the longitudinal direction to be fitted in the groove of the feed roller 2, a sensor flag 2*c* that covers a transmission type feed roller sensor 1*a* mounted on the main board 1, and a cam (not shown) for pressing the hopper 3 downward. These components rotate together about the roller shaft 31.

The hopper 3 is designed to come into contact with/separate from the feed roller 2 upon rotation of the feed roller 2. When the arcuated portion of the roller rubber 2*a* faces the sheet side, the hopper 3 presses a sheet against the feed roller 2 with the elastic force of a press spring 4. Note that contacting/separating operation of the hopper 3 with respect to the feed roller 2 is done by the cam on the feed roller side and the press spring 4.

Referring to FIG. 2, a base 40 pivotally holds the hopper 3 via a shaft 3*a*, and a separation base 8 is held on the base 40 to be movable in a direction (to be referred to as a "sheet widthwise direction" hereinafter) perpendicular to the sheet feed direction. The separation pad portion 7 is mounted on this separation base 8 to be pivotal about a rotating shaft 7*b*.

The separation pad portion 7 also includes a separation pad spring 7*c*. The separation pad portion 7 is urged in the direction of the feed roller 2 by the separation pad spring 7*c*. FIGS. 2 and 3 show a paper feed state wherein a sheet is fed. In this case, the flat portion of the feed roller 2 is substantially parallel to the separation pad 7*a*. The separation pad 7*a* is stopped by a stopper portion (not shown) at a position where it is not in contact with the feed roller 2. Only the arcuated portion of the feed roller 2 comes into contact with the separation pad 7*a*.

A roller 6 forms a stop position where it comes into contact with the separation pad 7*a* to stop a sheet. This roller 6 is placed at a position shifted in the sheet widthwise direction with respect to the feed roller 2, and is lightly pressed against the separation pad 7*a* with a spring (not shown) so as not to hinder its rotation. Since the roller 6 is lightly pressed against the separation pad 7*a* in this manner, when a sheet is fed, the separation pad 7*a* stops the next sheet that moves together with the fed sheet.

Referring to FIG. 3, a return pawl 9 serves as a sheet return means. The return pawl 9 is placed at a position shifted in the sheet widthwise direction with respect to the feed roller 2 and the roller 6 and pivotally held on the separation base 8 via a rotating shaft 9*a*. In this case, when a sheet is to be fed, the return pawl 9 is in a tilt position as shown in FIG. 3. When a sheet is to be returned or before feeding of a sheet is started, the return pawl 9 is held in a position substantially perpendicular to the separation pad 7*a* by a spring and stopper (not shown).

Referring to FIG. 3, a return pawl cam portion 2*d* is formed on a side of the feed roller 2 and has a recess 2*e*. When the return pawl 9 is in a position substantially perpendicular to the separation pad 7*a*, i.e., when a sheet is to be returned or before feeding of a sheet is started, the distal end portion of the return pawl 9 enters the recess 2*e*.

Combinations of the feed roller 2, a feed roller 2', the roller 6, the separation pad portion 7, the separation base 8, the return pawl 9, and the like will be referred to as feed units 30 and 30' hereinafter. The movable feed unit 30' can move on the roller shaft 31 in the sheet widthwise direction. The fixed feed unit 30 which is formed independently of the movable feed unit 30' and made up of parts almost symmetrical with those of the movable feed unit 30' is placed as shown in FIG. 4.

Since the second feed roller 2' of the movable feed unit 30' has a groove in phase with that of the first feed roller 2 of the fixed feed unit 30, the first and second feed rollers 2 and 2' pivot in phase upon rotation of the roller shaft 31.

Figure 4:
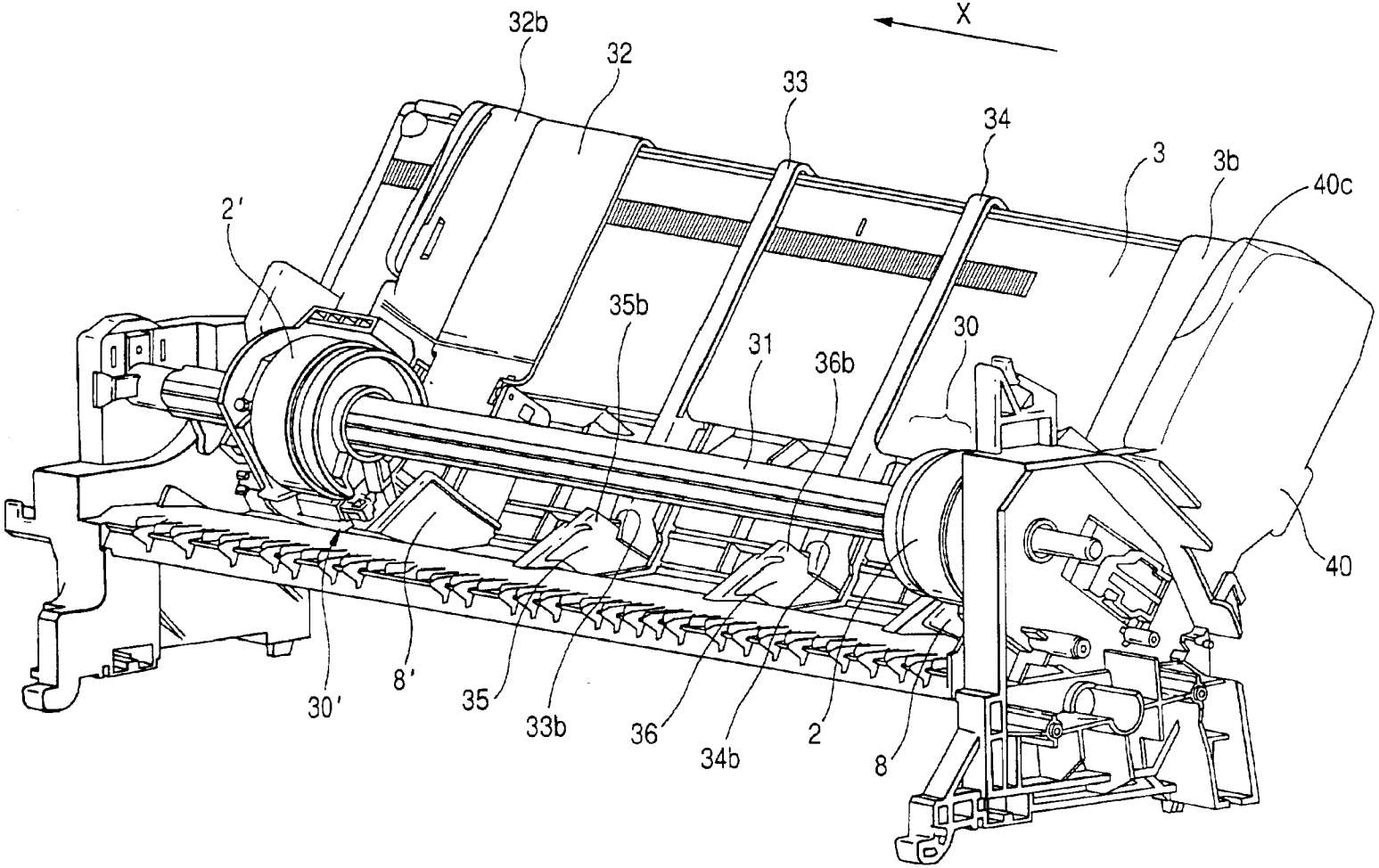
FIG. 4 is a perspective view showing an overall feeding apparatus shown in FIGS. 1 to 3.
Figure 5:
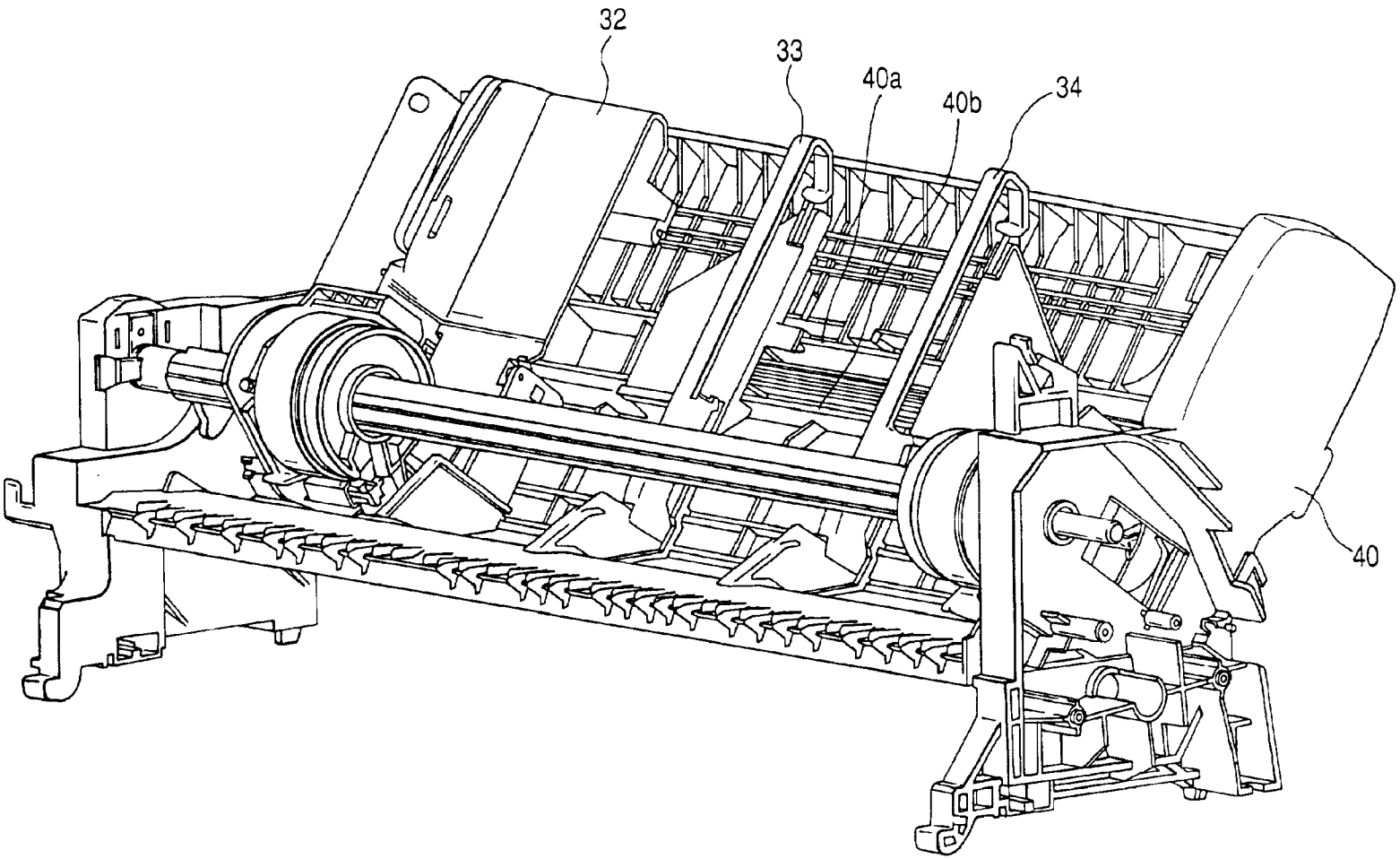
FIG. 5 is a perspective view showing a state wherein a hopper is removed from the feeding apparatus in FIG. 4.
Figure 6:
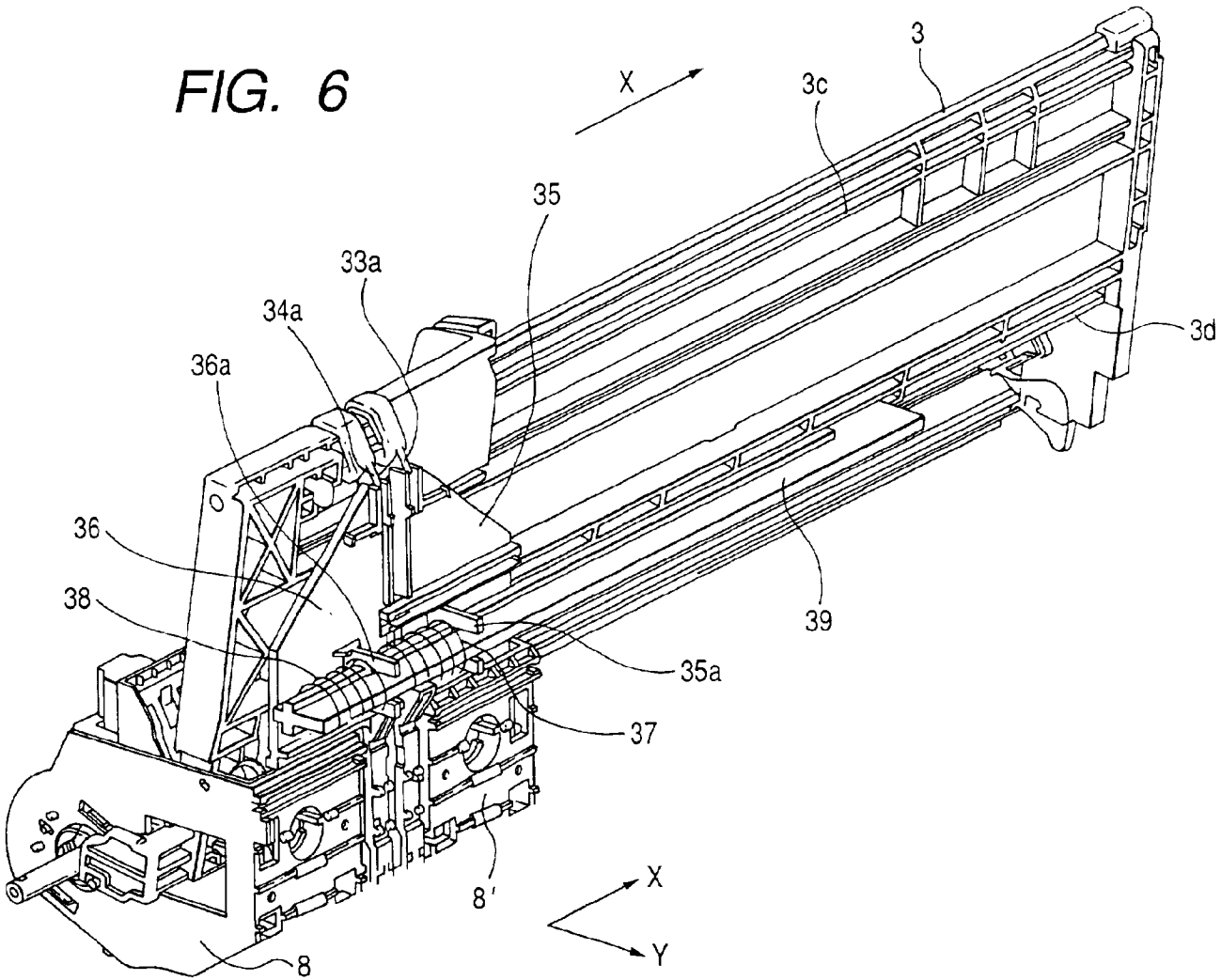
FIG. 6 is a perspective view showing the back-surface side of the feeding apparatus in FIG. 4.

FIG. 4 is a perspective view showing the overall sheet feeding apparatus shown in FIGS. 1 to 3. FIG. 5 is a perspective view showing a state wherein the hopper is removed from the sheet feeding apparatus shown in FIG. 4. FIG. 6 is a perspective view showing the back-surface side of the sheet feeding apparatus shown in FIG. 4.

The hopper 3 has a side guide 32 serving as the second supporting member and a sheet width restricting means slidably mounted in the sheet widthwise direction. The user can freely adjust the side guide 32 to the width of a sheet stacked by sliding the side guide 32. The side guide 32 has an engaging portion (not shown) which is engaged with the side plate of the separation base 8 of the movable feed unit 30'. When the user slides the side guide 32, the movable feed unit 30' also slides.

A left-side sheet support member 33 and right-side sheet support member 34 are arranged between a surface 3*b*, serving as the first supporting member, of the hopper 3 and the side guide 32 so as to sandwich the hopper 3. Like the side guide 32, these support members can slide in the sheet widthwise direction along rails 3*c* and 3*d* on the back surface of the hopper 3, as shown in FIG. 6. Flag-like portions 33*a* and 34*a* (see FIG. 6) are respectively mounted on the upper portions of the left-side sheet support member 33 and right-side sheet support member 34, which together form the third supporting member. In addition, groove-like portions 33*b* and 34*b* are respectively formed in the bottom portions of the left-side sheet support member 33 and right-side sheet support member 34, as shown in FIG. 4. The side guide 32 is almost flush with the surface 3*b* of the hopper 3. Likewise, the two sheet support members 33 and 34 are almost flush with the surface 3*b*.

Two sheet support bases, namely a left-side sheet support base (to be referred to as a "left-side PS base" hereinafter) 35 and a right-side sheet support base (to be referred to as a "right-side PS base" hereinafter) 36 having a symmetrical shape with respect to the left-side PS base 35, are arranged below the hopper 3 mounted on the base 40. These support bases can independently slide in the sheet widthwise direction on rail portions 40*a* and 40*b* (see FIG. 5).

As shown in FIG. 6, the left-side PS base 35 and right-side PS base 36 respectively have projections 35*a* and 36*a*. A left-side sheet support base spring (to be referred to as a "left-side PS spring" hereinafter) 37 is placed between the two projections 35*a* and 36*a*. A right-side PS spring 38 is placed between the projection 36*a* serving as the spring bearing portion of the right-side PS base 36 and an inner plate 40*c* (see FIG. 4 and the like) of the base 40. In this manner, the respective PS bases 35 and 36 are urged in the sheet widthwise direction by the two springs 37 and 38 serving as urging means. The right-side PS base 36 is, in particular, urged by the two springs 37 and 38 acting in opposite directions to be always located at the middle between the left-side PS base 35 and the inner plate 40*c* of the base 40.

A sheet support base spring shaft (to be referred to as a "PS spring shaft" hereinafter) 39 is fixed between the rail portions 40*a* and 40*b* (see FIG. 5) of the base 40, and the left-side PS spring 37 and right-side PS spring 38 are inserted in the PS spring shaft 39, thereby allowing these PS springs 37 and 38 to smoothly extend/contract. The PS spring shaft 39 also serves as a rail for the left-side PS base 35 and right-side PS base 36 to prevent them from moving in the Y direction in FIG. 6.

Figure 7:
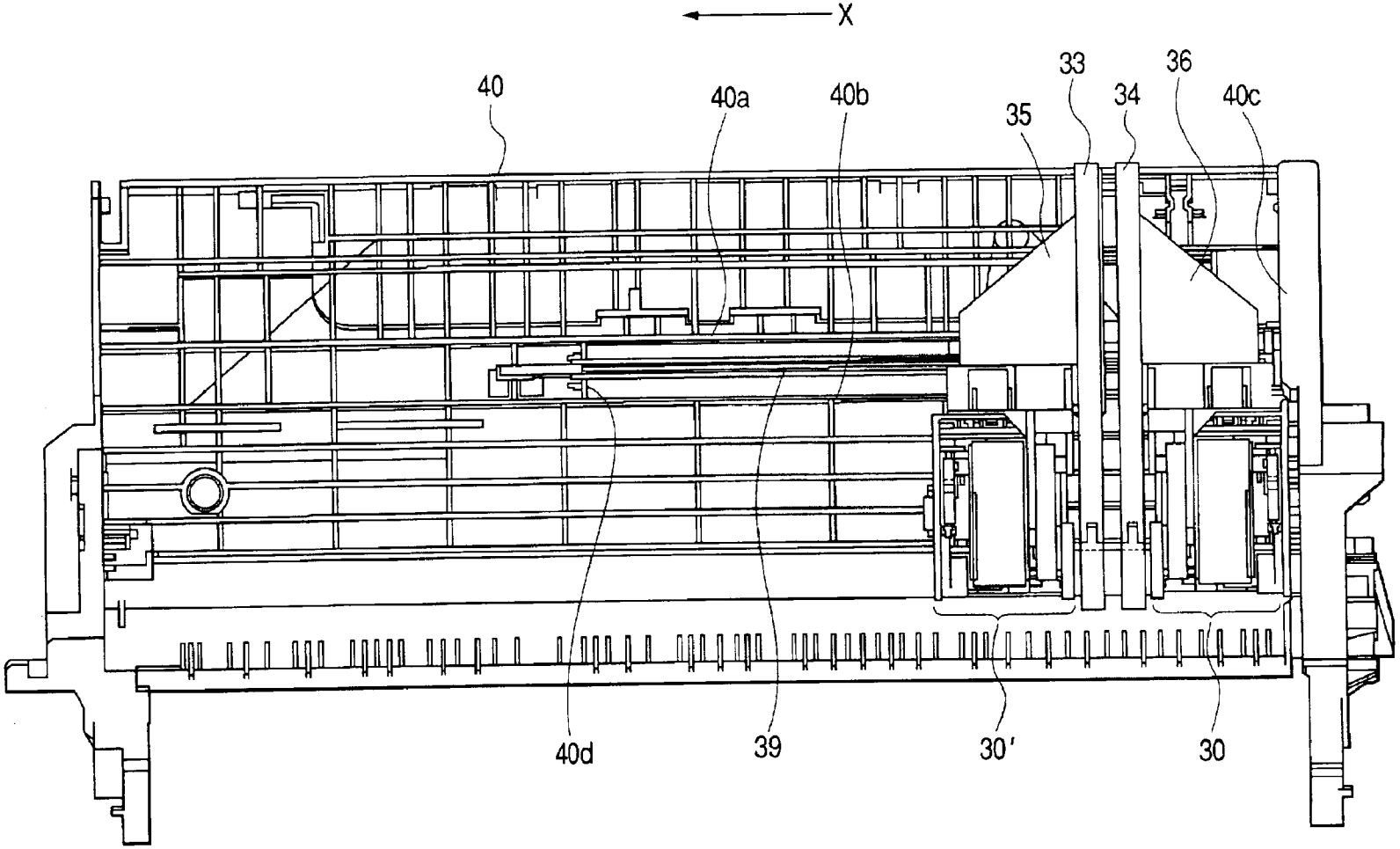
FIG. 7 is a front view showing a state wherein a left-side PS base is brought close to a right-side PS base in the feeding apparatus in FIG. 4.
Figure 8:
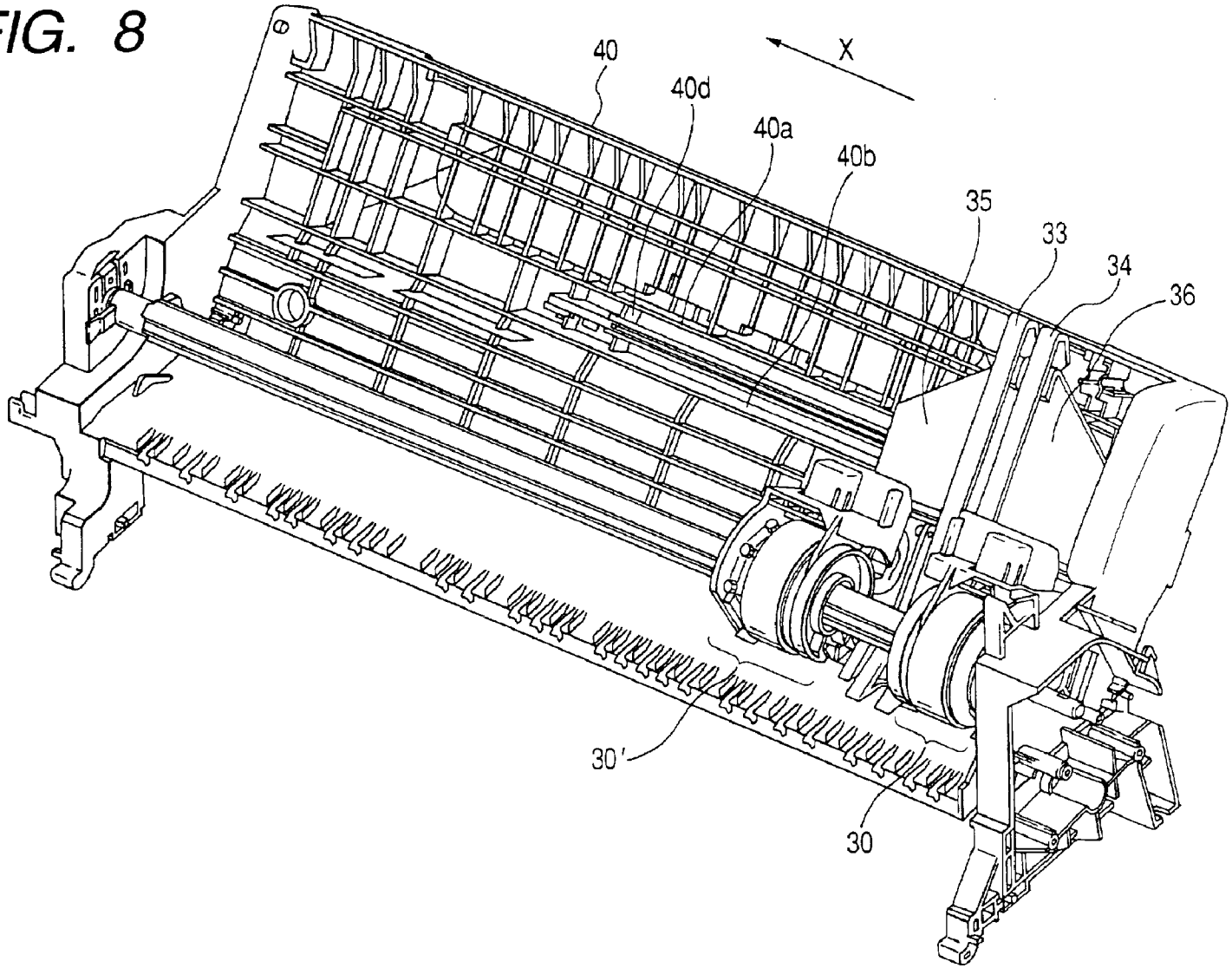
FIG. 8 is a perspective view showing the feeding apparatus in the state shown in FIG. 7.

FIG. 7 is a front view of the sheet feeding apparatus in FIG. 4 in a state wherein the left-side PS base is brought close to the right-side PS base. FIG. 8 is a perspective view showing the sheet feeding apparatus in the state shown in FIG. 7.

As shown in FIGS. 7 and 8, the base 40 has a stopper portion 40*d*. Since the projection 35*a* of the left-side PS base 35 comes into contact with the stopper portion 40*d*, the left-side PS base 35 cannot move beyond the stopper portion 40*d* in the X direction in FIGS. 7 and 8.

As shown in FIG. 4, in the sheet feeding apparatus 21, the groove-like portions 33*b* and 34*b* of the sheet support members 33 and 34 are formed to clamp projections 35*b* and 36*b* of the left-side PS base 35 and right-side PS base 36. In addition, as shown in FIGS. 4 and 6, groove-like portions 35*c* and 36*c* of the left-side PS base 35 and right-side PS base 36 are formed to clamp the flag-like portions 33*a* and 34*a* of the sheet support members 33 and 34. With this arrangement, the left-side PS base 35 and left-side sheet support member 33 can move together in the X direction in FIGS. 7 and 8. Likewise, the right-side PS base 36 and right-side sheet support member 34 can move together in the X direction in FIGS. 7 and 8.

Referring back to FIGS. 2 and 3, convey roller pairs 11 and 12 serve as convey means for conveying a fed sheet. A transmission type sheet edge sensor 1*f* serves as a sheet edge detecting means which is mounted on the main board 1 and serves to detect the leading or trailing edge of a sheet. An actuator 10 is pressed by a fed sheet. The sheet edge sensor 1*f* detects the leading and trailing edges of the sheet as the actuator 10 swings.

On the other hand, the first feed roller 2 is driven by a feed motor (stepping motor) (not shown) via the roller shaft 31.

The main board 1 is comprised of a CPU for controlling the overall printer apparatus 20 to make the return pawl 9 perform returning operation, a motor driver for directly controlling the feed motor, a RAM which temporarily stores constants, an EEPROM storing operation parameters for the printer apparatus 20, e.g., a control table for the feed motor, and the like. The printer apparatus 20 performs recording when a print command is sent from a host computer mounted inside or outside the printer apparatus 20 to the CPU of the main board 1.

Operation of stacking sheets on the sheet feeding apparatus 21 having the above arrangement will be described next.

Operation of stacking sheets with a sheet width equal to or larger than that of a B4-size sheet will be described first by exemplifying the case of A3-size sheets.

In stacking wide sheets such as A3-size sheets or B4-size sheets on the hopper 3, the user so moves the side guide 32 as to stack A3-size sheets, and increases the distance between a guide surface 32*b* of the side guide 32 and the inner plate 40*c* of the base 40 shown in FIG. 4 to be larger than the sheet width of A3-size sheets.

At this time, the left-side PS base 35 urged in the X direction in FIG. 4 by the left-side PS spring 37 (see FIG. 6) is positioned at the stopper portion 40*d* (see FIG. 7) of the base 40, and the right-side PS base 36 is clamped between the left-side PS spring 37 and the right-side PS spring 38 to be located at the middle between the left-side PS base 35 and the inner plate 40*c*. Since the left-side sheet support member 33 and right-side sheet support member 34 are integral with the left-side PS spring 37 and right-side PS spring 38, respectively, they move to the same positions.

In this state, the user stacks an A3-size sheet bundle on the hopper 3 while aligning the right end of the bundle with the inner plate 40*c* of the base 40, and also slides the side guide 32 to align it with the left end of the A3-size sheet bundle, thereby completing stacking of the sheet bundle.

As described above, even if wide sheets such as A3-size sheets are stacked, the sheet bundle can be reliably supported at the same level as that of the two ends in the sheet widthwise direction at two positions in the area where the movable feed unit 30' moves.

In practice, the position of the stopper portion 40*d* of the base 40 is so determined as to evenly support A3-size sheets at the positions of the left-side sheet support member 33 and right-side sheet support member 34 in consideration of the fact that the frequency of use of A3-size sheets is the highest among sheets equal to or larger than B4 size. For sheets equal or larger than B4 size, therefore, the sheet support members 33 and 34 and PS bases 35 and 36 are always positioned as shown in FIG. 4.

Operation of stacking sheets having a sheet width smaller than B4 size will be described next by exemplifying the case of A4-size sheets.

Figure 9:
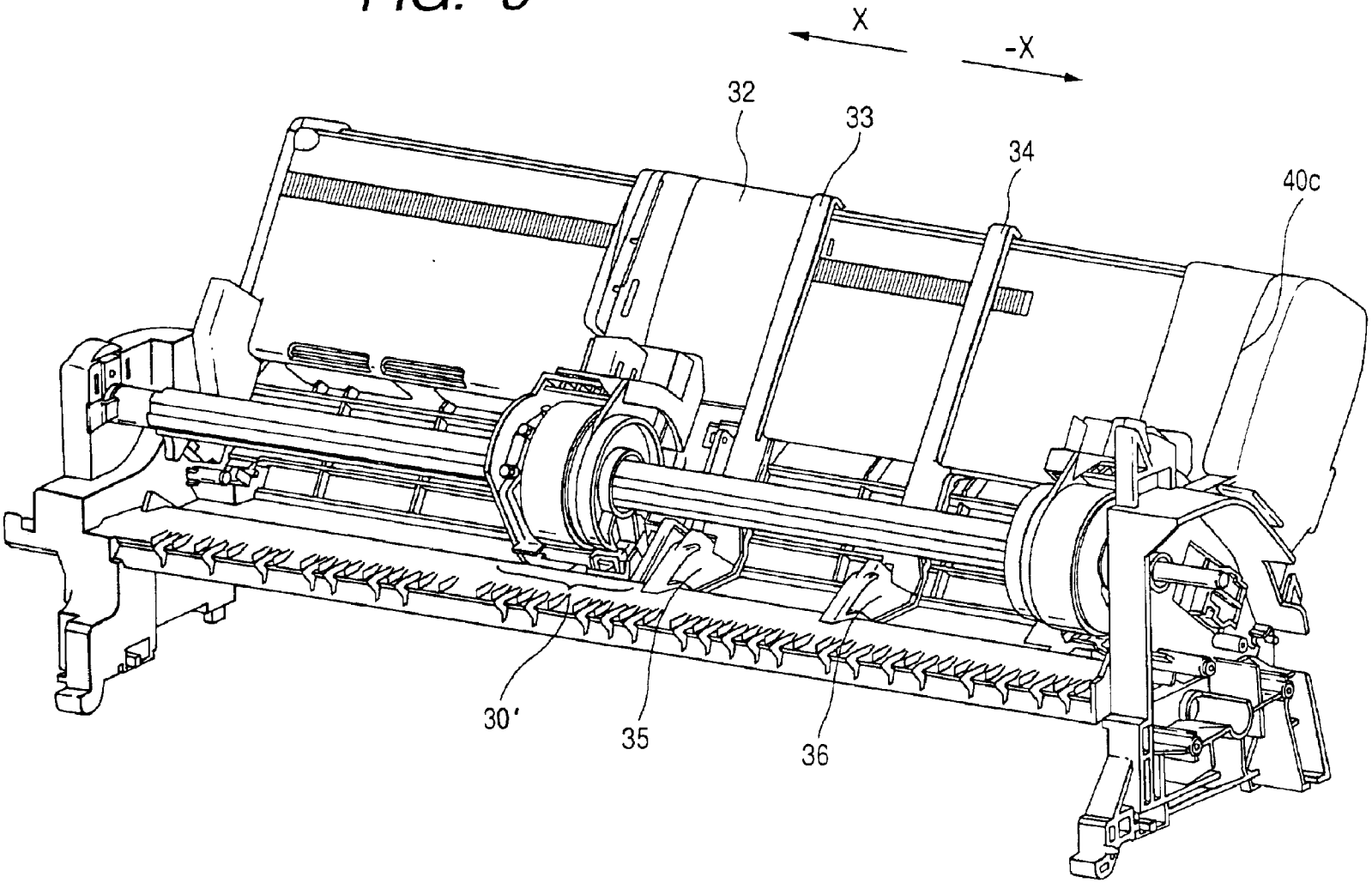
FIG. 9 is a view for explaining sheet stacking operation in the feeding apparatus in FIG. 4.

The user slides the side guide 32, located at the position where it supports A3-size sheets, in the X direction in FIG. 9 to allow A4-size sheets to be stacked.

At this time, the side guide 32 comes into contact with the left-side sheet support member 33 located at the stopper portion 40*d* (see FIG. 7). As the user further slides the side guide 32, the left-side sheet support member 33 is pushed. With this operation, the left-side sheet support member 33 slides to a position where the distance between the guide surface 32*b* of the side guide 32 and the inner plate 40*c* of the base 40 becomes larger than the sheet width of A4-size sheets.

The left-side PS base 35 moves together with the left-side sheet support member 33 to be located at the same position as that of the left-side sheet support member 33. The right-side PS base 36 is clamped between the left-side PS spring 37 and the right-side PS spring 38 and positioned at the middle between the left-side PS base 35 and the 40*c*. The right-side sheet support member 34 moves together with the right-side PS base 36 and located at the same position as that of the right-side PS base 36.

In this state, the user stacks an A4-size sheet bundle while aligning its right end with the inner plate 40*c* of the base 40, and slides the side guide 32 to align it with the left end of the A4-size sheet bundle, thereby completing stacking of the sheet bundle.

Even when narrow sheets like A4-size sheets are stacked, the sheet bundle can be reliably supported at the same level as that of the two ends in the sheet widthwise direction in almost the middle of sheet width at one position in the area where the movable feed unit 30' moves.

Normal feeding operation in the printer apparatus 20 having the above arrangement will be described next.

Figure 10:
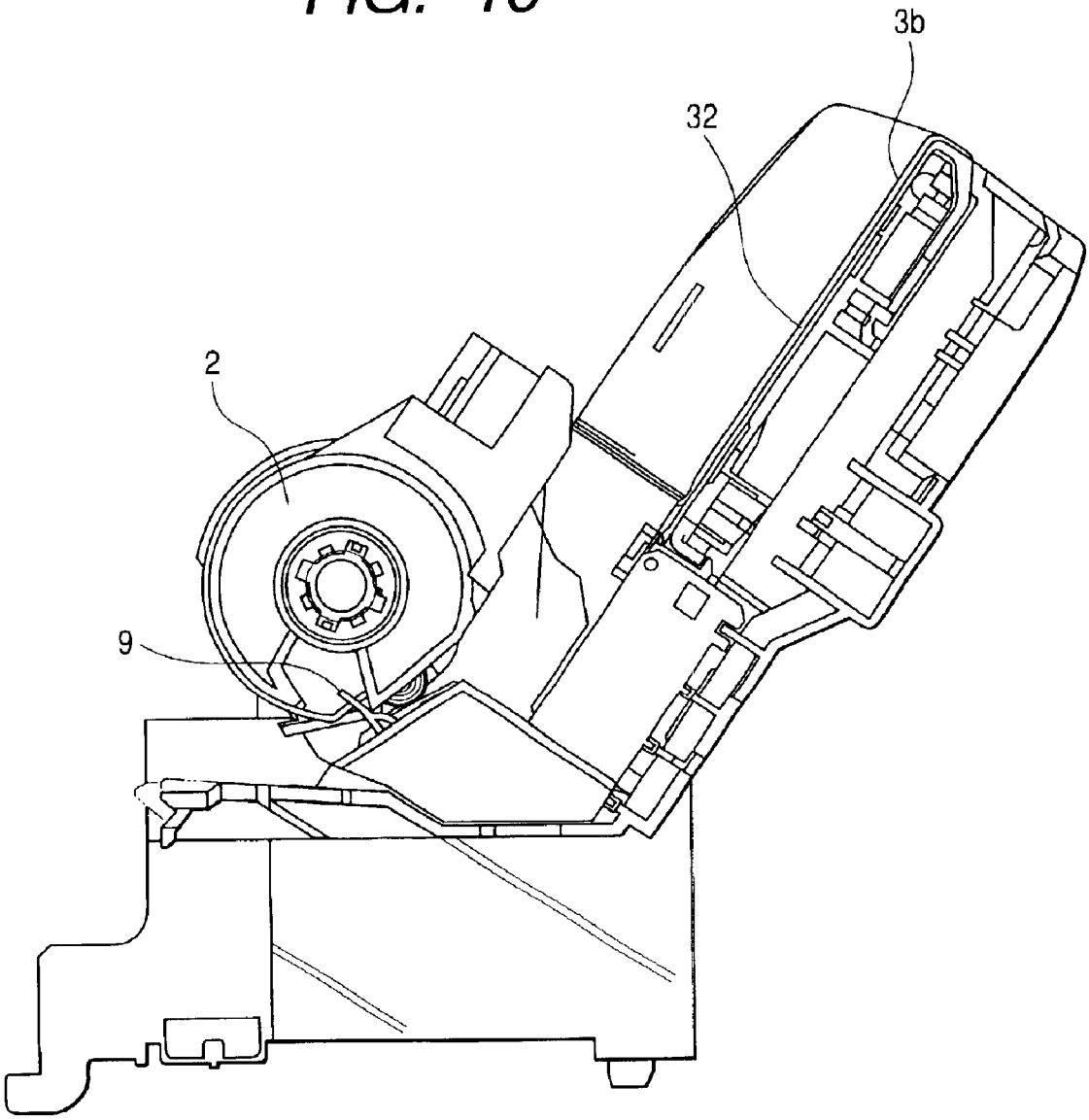
FIG. 10 is a sectional view showing a standby state at the position where each feeding unit of the feeding apparatus in FIG. 4 is placed.
Figure 11:
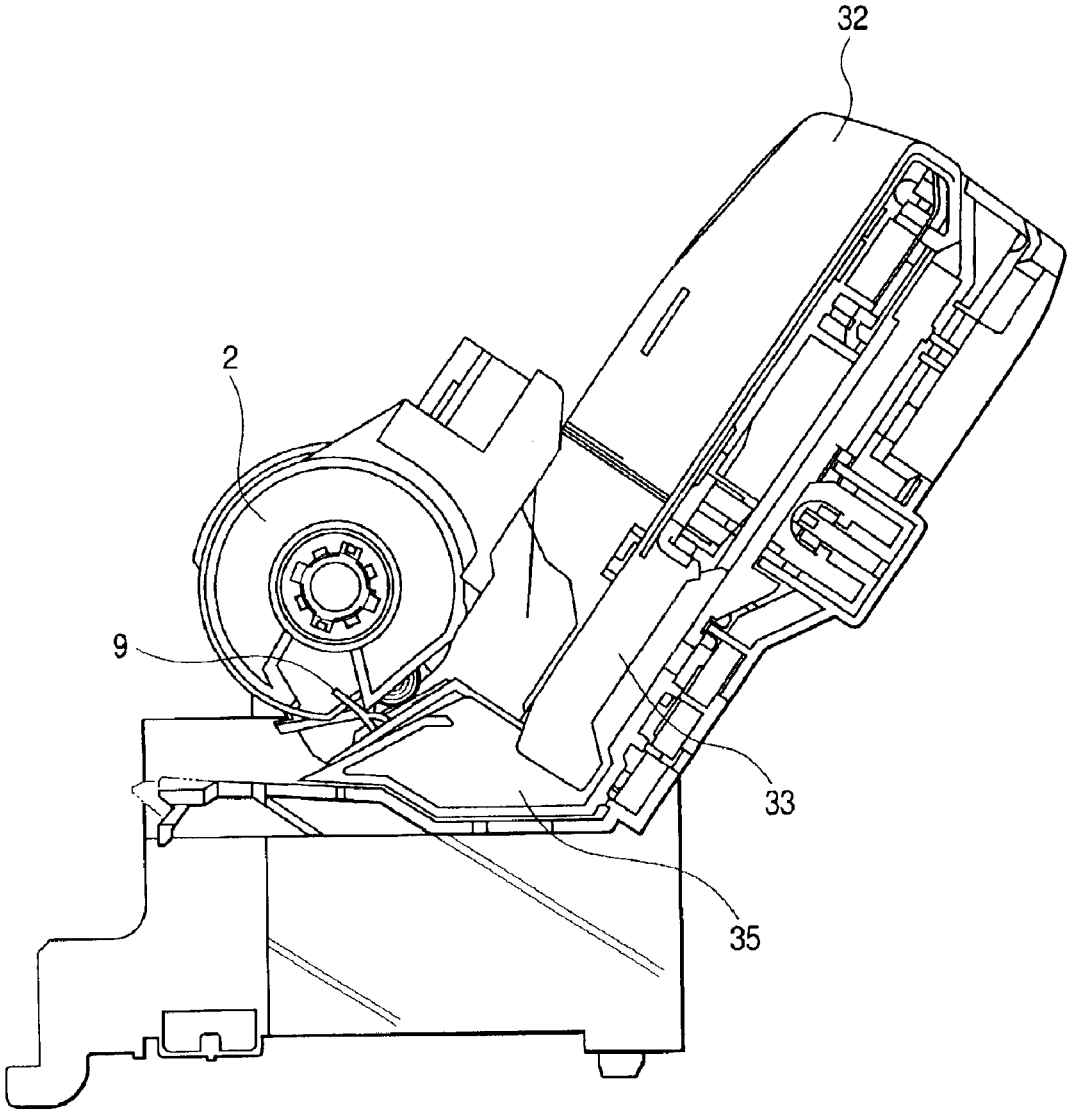
FIG. 11 is a sectional view showing a standby state at the positions where each sheet support member and each PS base of the feeding apparatus in FIG. 4 are placed.

FIG. 10 is a sectional view showing the standby states of the feed units 30 and 30' at the positions where they are placed. FIG. 11 is a sectional view showing the standby states of the respective sheet support members 33 and 34 and PS bases 35 and 36 at the positions where they are placed.

When an image forming command is output from the host computer (not shown) to the CPU of the main board 1, the CPU checks whether the command is for the first sheet. If the command is for the first sheet, since the return pawl 9 at the pawl return position where it is held in a position almost perpendicular to the separation pad 7*a* as described above, the feed motor is rotated in the forward direction via the motor driver so as to rotate the feed roller 2 in the forward direction, thereby moving the return pawl 9 to the position shown in FIG. 10.

After the apparatus is set in a state wherein a sheet can be fed in this manner, the feed motor is continuously rotated in the forward direction to make the feed roller 2 start feeding a sheet. When the feed roller 2 rotates in this manner, the contact between the cam portion (not shown) and the hopper 3 or side guide 32 is released at the same time. As shown in FIG. 2, the hopper 3 that pivots about the shaft 3*a* or the side guide 32 is then urged toward the feed roller 2 by the press spring 4.

At this time, at the positions where the right-side sheet support member 34 and right-side PS base 36 are placed, the right-side sheet support member 34, which pivots together with the hopper 3, can support a sheet bundle at its leading edge middle portion at the surface that is almost flush with the surface 3*b* of the hopper 3, as shown in FIG. 4. The left-side sheet support member 33 and left-side PS base 35 also pivot together with the hopper 3, and the sheet bundle can also be supported at the positions where the left-side sheet support member 33 and left-side PS base 35 are placed. This makes it possible to stably press a sheet against the first feed roller 2 without causing any feed failure due to the deformation of the leading edge middle portion even if the sheet is a wide sheet such as an A3-size sheet.

In this state, the uppermost sheet of the sheet bundle begins to be conveyed and fed to the separation pad 7 upon rotation of the feed roller 2.

At this time, the leading edge of the stacked sheet bundle is in contact with a back-surface wall 7*d* of the separation pad portion 7, and several sheets begin to be conveyed from this position. In addition, at this time, the sensor flag 2*c* also rotates upon rotation of the feed roller 2. As a result, the output from the feed roller sensor 1*a* changes from an ON state to an OFF state. The CPU uses this sensor output change point as the starting point of the operation amount of roller rotation.

The conveyed sheets are guided to the nip portion between the feed roller 2 and the separation pad 7*a*, and the leading edges of sheets below the uppermost sheet are restricted by the separation pad 7*a*. As a consequence, the uppermost sheet and the remaining sheets are gradually separated from each other as if a wedge were driven therebetween, and only the uppermost sheet is separated and conveyed in the lower left direction in FIG. 2. At this time, the return pawl 9 (see FIG. 3) is pushed by the leading edge of the sheet and pivots counterclockwise. The return pawl 9 does not therefore hinder any movement of the sheet.

Figure 12:
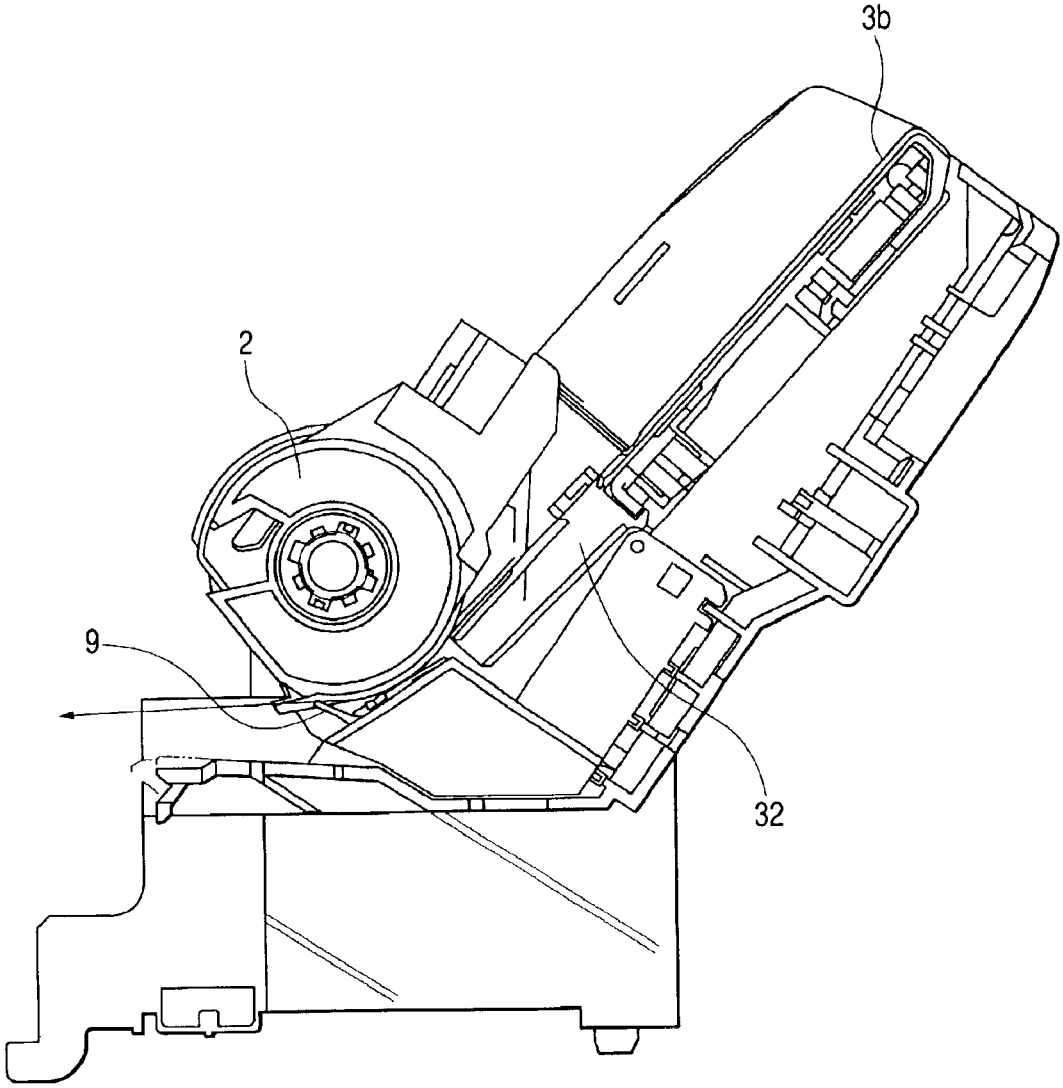
FIG. 12 is a view for explaining a sheet convey route in the feeding apparatus in FIG. 4.
Figure 13:
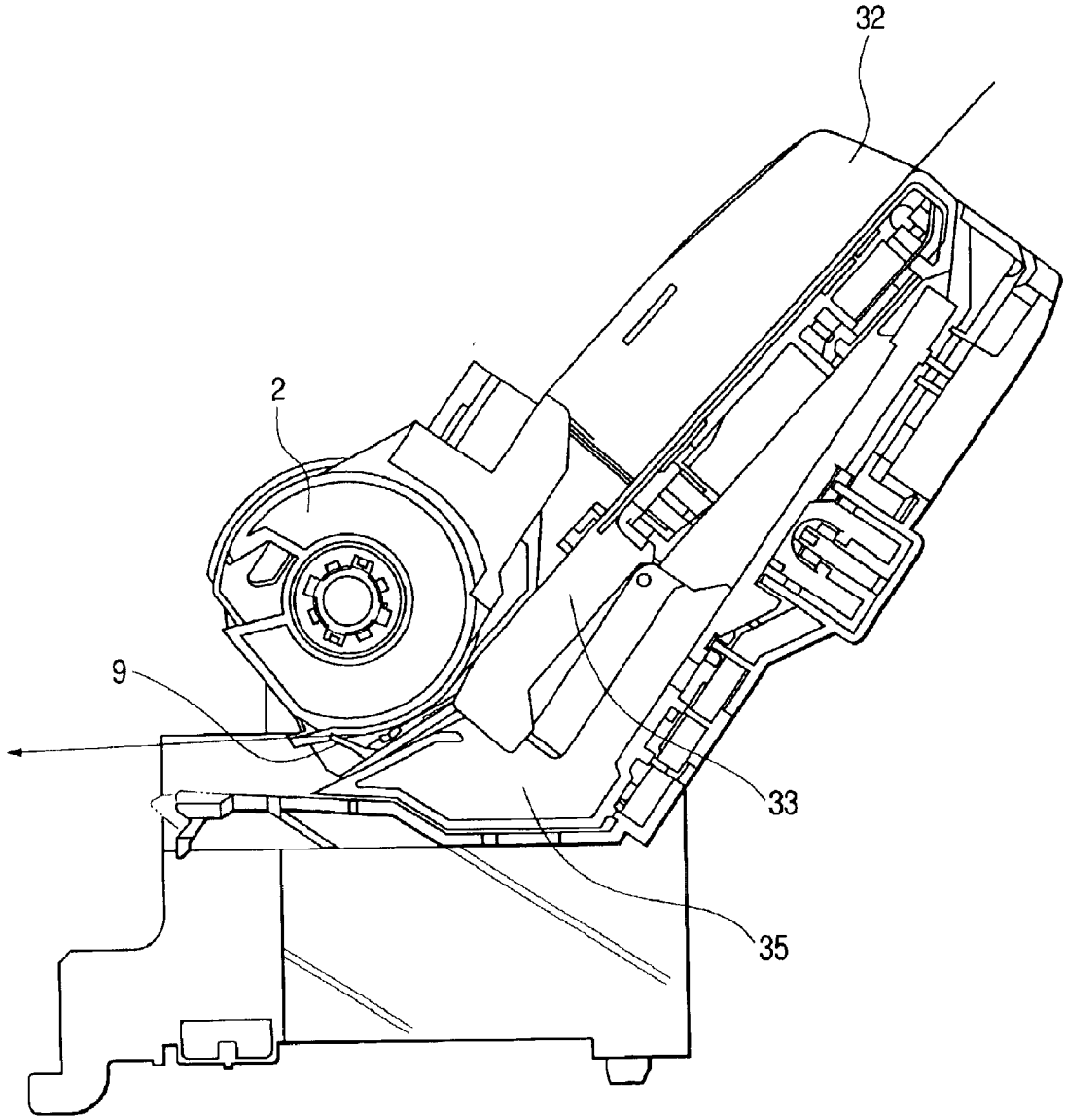
FIG. 13 is a view for explaining a sheet convey route in the feeding apparatus in FIG. 4.

At this time, one separated sheet is conveyed along the route shown in FIG. 12 with its two ends in the widthwise direction sliding along the separation pad 7*a*. At the positions where the right-side sheet support member 34 and right-side PS base 36 are placed, as shown in FIG. 13, the right-side sheet support member 34 serving as a sheet support means, which pivots together with the hopper 3, forms a convey route almost identical to the convey route formed by the hopper 3. In addition, the right-side PS base 36 serving as a sheet guide member forms a convey route almost identical to the convey route formed by the feed rollers 2 and 2' constituting a sheet feed means. The sheet is guided along these convey routes. At the positions where the left-side sheet support member 33*a* and left-side PS base 35 are placed, a convey route is formed in the same manner, and the sheet is guided along this route. This prevents the sheet from being deformed and bent at the middle portion of the sheet, and makes it possible to guide the sheet along the convey routes in an ideal state throughout the sheet width.

The uppermost sheet separated in this manner reaches the actuator 10 (see FIG. 3) to swing the actuator 10 as it is conveyed. With this operation, the distal end of the actuator 10 goes out of the light-shielding portion of the sheet edge sensor (PE sensor) 1*f*. This allows the sheet edge sensor 1*f* to detect the leading edge of the sheet.

In this embodiment, the convey roller pair 11 corrects the skew of the sheet, and the CPU uses this detection signal from the sheet edge sensor 1*f* as the starting point of the operation amount required to convey the sheet to the convey roller pair 11 and further convey the sheet until a loop is formed while it is in contact with the convey roller pair 11.

When the feed roller 2 further rotates, the leading edge of the sheet fed into the printer apparatus 20 comes into contact with a contact point of the convey roller pair 11. After a loop is formed by further feeding the sheet by about 3 mm to correct the skew, the motor is temporarily stopped. Note that the convey amount until then is determined as a constant amount on the basis of leading edge detection.

The convey roller pairs 11 and 12 and first feed roller 2 start to rotate at the same peripheral speed. Immediately after this operation, the leading edge of a sheet is clamped between the convey roller pair 11 and conveyed. In addition, when the cam (not shown) of the feed roller pushes the hopper 3 downward, and the feed roller 2 is stopped in the state shown in FIG. 2, thereby completing the convey operation. At this time, the feed roller 2 is stopped when the flag of the feed roller sensor 1*a* is turned on. Note that the feed roller 2 may be stopped when the flag of the feed roller sensor 1*a* is turned off, which indicates the start of rotation.

After this operation, the sheet is conveyed downstream from the convey roller pairs 11 and 12 driven by a drive source (not shown) and registered. At the same time, an image is formed on the sheet by the recording head 13*a*. At this time, the image formation position is managed on the basis of the convey amount of the convey roller after the sheet comes into contact with the convey roller pair 11.

Although sheets other than the uppermost sheet are also fed with the friction between the uppermost sheet and the remaining sheets during this operation, the leading edges of the sheets are blocked by the pressure-contact portion (stop position) between the roller 6 and the separation pad 7*a* to prevent them from being further fed. This prevents multiple sheet feeding. If, however, sheets (two or more, in particular) other than the uppermost sheet pass through the pressure-contact portion (stop position) between the roller 6 and the separation pad 7*a* for some reason, nothing exists which blocks the sheets, resulting in multiple sheet feeding due to the frictional force received from the uppermost sheet that is being conveyed. Once this state occurs, the roller 6 is pushed upward by the sheets to accelerate the tendency to let sheets pass through the roller 6.

When images are to be consecutively formed on two or more sheets, in order to prevent such multiple sheet feeding, sheet returning operation is performed by the return pawl 9. When, for example, images are to be formed on plain paper, sheet separation can be done relatively stably, and images are printed on a relatively large number of sheets. For this reason, priority is given to image forming speed, and time-consuming sheet returning operation is performed once for every seven sheets. For special paper sheets other than plain paper, sheet returning operation is performed for each sheet.

(Second Embodiment)

Figure 14:
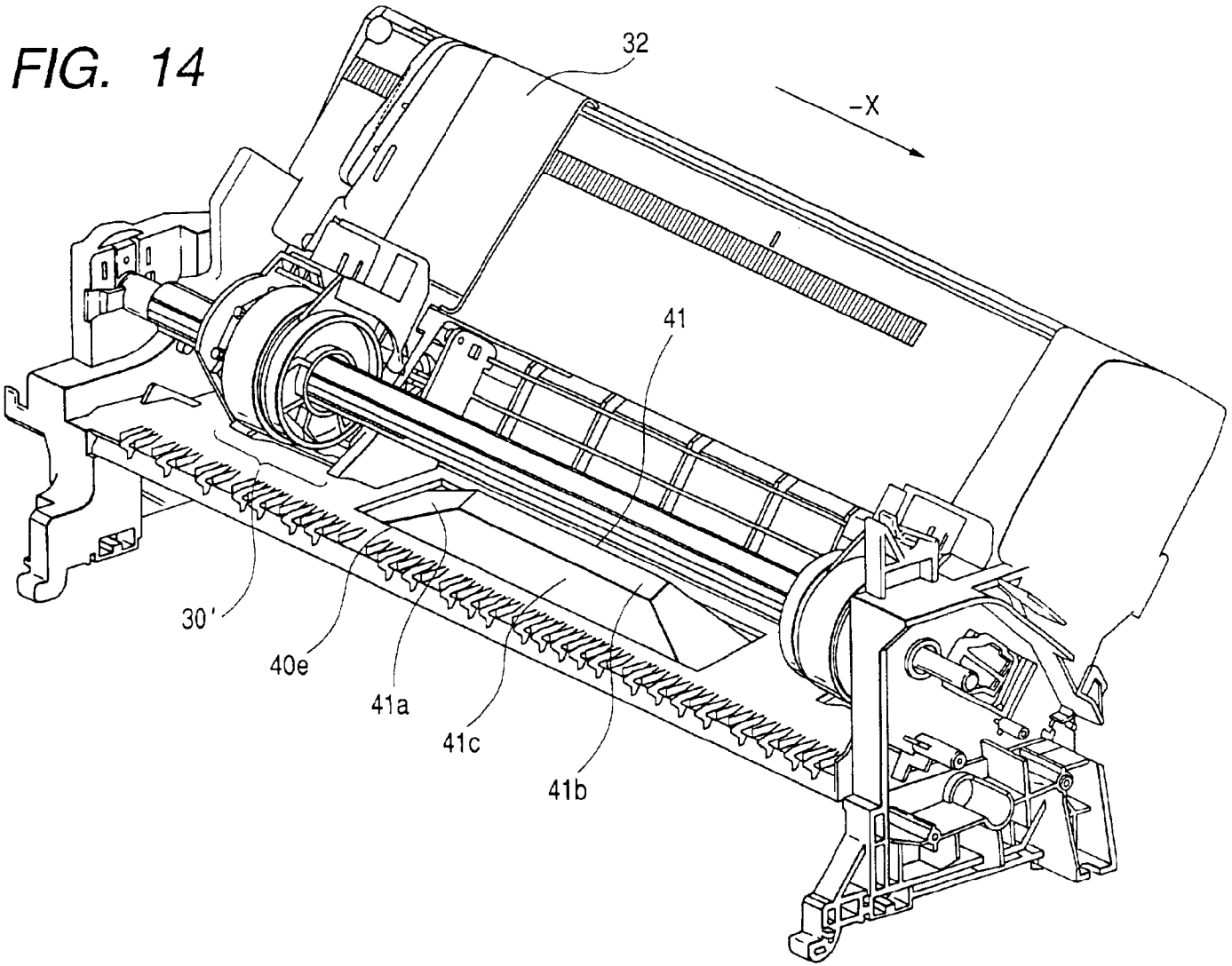
FIG. 14 is a schematic perspective view showing an overall feeding apparatus according to the second embodiment of the present invention.
Figure 15:
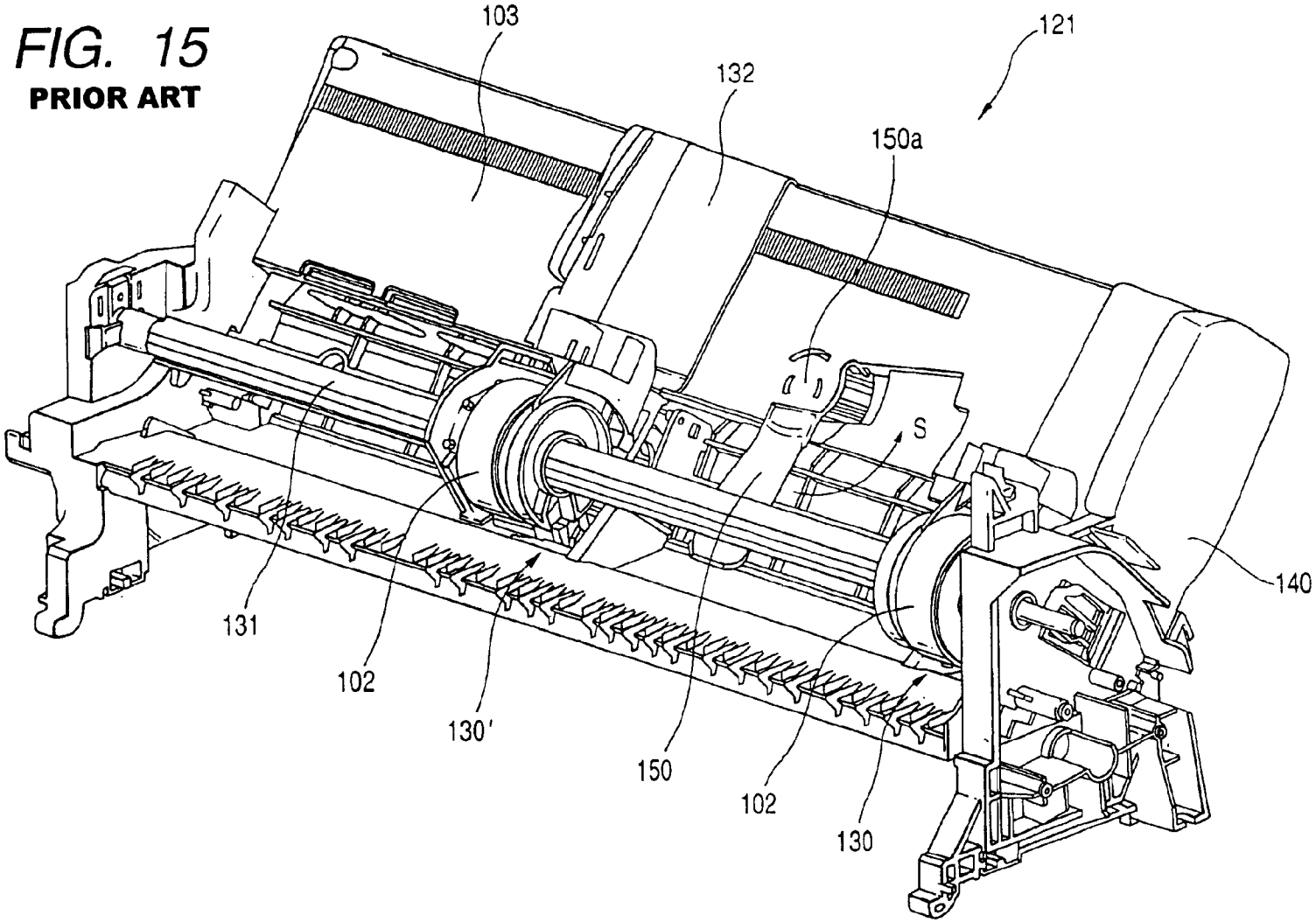
FIG. 15 PRIOR ART
FIG. 15 is a perspective view showing the schematic arrangement of a conventional feeding apparatus.

FIG. 14 is a schematic perspective view showing an overall sheet feeding apparatus according to the second embodiment of the present invention. This embodiment uses a sheet support projection 41 in place of the sheet support members 33 and 34 and PS bases 35 and 36 in the first embodiment. The other arrangements are almost the same as those of the first embodiment.

A hole 40*e* is formed in the lower portion of a base 40 in a space where a movable feed unit 30' moves in the sheet widthwise direction, and the sheet support projection 41 protrudes from the hole 40*e*. The sheet support projection 41 is urged in the direction to protrude from the hole 40*e* by a spring (not shown).

When wide sheets such as A3-size sheets are to be stacked, the sheet support projection 41 is made to protrude from the hole 40*e* as shown in FIG. 14 to support the middle portion of a sheet bundle (not shown) at a ceiling portion 41*b* so as not to make the bundle bend. When a sheet is fed, the sheet is guided along a convey route by an inclined portion 41*c*.

When narrow sheets such as A4-size sheets are to be stacked, the user slides a side guide 32 interlocked with the movable feed unit 30' in the −X direction in FIG. 14. As a consequence, the movable feed unit 30' comes into contact with an inclined portion 41*a* of the sheet support projection 41. When the side guide 32 is further moved, the sheet support projection 41 is pushed against the urging force of the spring (not shown) and accommodated into the hole 40*e* of the base 40. This makes it possible to further move the movable feed unit 30' in the −X direction.

When wide sheets such as A3-size sheets are stacked again, the user slides the side guide 32 in the X direction. As a result, the sheet support projection 41 accommodated in the hole 40*e* of the base 40 is urged in the direction to protrude from the hole 40*e* by the spring (not shown) and protrudes from the hole 40*e* again. In the above manner, a sheet bundle is supported by the ceiling portion 41*b* of the sheet support projection 41 so as not to make the middle portion of the sheet bundle bend. In feeding a sheet, the inclined portion 41*c* guides it along the convey route.

In each embodiment described above, the present invention is applied to a serial type recording apparatus designed to move a recording head in the main scanning direction. However, the present invention can also be applied to a full-line type recording apparatus designed to print an image by using a recording head extending throughout the entire width of a recording sheet while continuously conveying a recording sheet.

Each embodiment described above has exemplified the apparatus using the recording head of the so-called BJ scheme of the ink-jet schemes. However, the present invention can be applied to various recording schemes as well as this recording scheme using a recording head. As a recording scheme using a recording head, a piezoelectric scheme may be used other than the BJ scheme.

As has been described above, this embodiment includes at least one sheet support member which is placed at a position different from that of a sheet feed means within an area where the sheet feed means can move and supports sheets stacked on a sheet stacking means, and/or at least one sheet guide member for guiding a sheet conveyed by the sheet feed means. These members can move in the sheet widthwise direction independently of the sheet feed means. With this arrangement, sheets can be properly supported throughout the entire area in the widthwise direction, and hence occurrence of a sheet feed failure can be prevented.

What is claimed is:

1. A sheet feeding apparatus comprising:

a first supporting member for supporting one end of a sheet;

a first feeding roller, opposite to said first supporting member, for feeding a sheet;

a second supporting member, placed movably in a sheet width direction, for supporting the other end of the sheet;

a second feeding roller, placed movably in the sheet width direction and opposite to said second supporting member, for feeding the sheet;

a third supporting member, placed between said first supporting member and said second supporting member, for supporting the sheet, said third supporting member being movable in the sheet width direction, in combination with said second supporting member; and urging means for urging said third supporting member in the widthwise direction of the sheet to place said third supporting member at a predetermined position.

2. An apparatus according to claim 1, further comprising at least two urging means which act in opposite directions in the widthwise direction of the sheet.

3. A sheet feeding apparatus comprising:

a first supporting member for supporting one end of a sheet;

a first feeding roller, opposite to said first supporting member, for feeding a sheet;

a second supporting member, placed movably in a sheet width direction, for supporting the other end of the sheet;

a second feeding roller, placed movably in the sheet width direction and opposite to said second supporting member, for feeding the sheet;

a third supporting member, placed between said first supporting member and said second supporting member, for supporting the sheet, said third supporting member being movable in the sheet width direction, in combination with said second supporting member; and a sheet guide member which guides the sheet fed by said first feeding roller and said second feeding roller, said sheet guide member being movable in the widthwise direction of the sheet together with said third supporting member.

4. An apparatus according to claim 3, wherein said sheet guide member forms a convey route substantially identical to a sheet convey route formed by said first feeding roller and said second feeding roller.

5. An image forming apparatus for forming an image on a sheet by using a recording head, comprising:

a head mount portion on which the recording head is mounted;

a first supporting member for supporting one end of a sheet;

a first feeding roller, opposite to said first supporting member, for feeding a sheet;

a second supporting member, placed movably in a sheet width direction, for supporting the other end of the sheet;

a second feeding roller, placed movably in the sheet width direction and opposite to said second supporting member, for feeding the sheet;

a third supporting member, placed between said first supporting member and said second supporting member, for supporting the sheet, said third supporting member being movable in the sheet width direction, in combination with said second supporting member; and urging means for urging said third supporting member in the widthwise direction of the sheet to place said third supporting member at a predetermined position.

6. An apparatus according to claim 5, further comprising at least two urging means which act in opposite directions in the widthwise direction of the sheet.

7. An image forming apparatus for forming an image on a sheet by using a recording head, comprising:

a head mount portion on which the recording head is mounted;

a first supporting member for supporting one end of a sheet;

a first feeding roller, opposite to said first supporting member, for feeding a sheet;

a second supporting member, placed movably in a sheet width direction, for supporting the other end of the sheet;

a second feeding roller, placed movably in the sheet width direction and opposite to said second supporting member, for feeding the sheet;

a third supporting member, placed between said first supporting member and said second supporting member, for supporting the sheet, said third supporting member being movable in the sheet width direction, in combination with said second supporting member; and a sheet guide member which guides the sheet fed by said first feeding roller and said second feeding roller, said sheet guide member being movable in the widthwise direction of the sheet together with said third supporting member.

8. An apparatus according to claim 7, wherein said sheet guide member forms a convey route substantially identical to a sheet convey route formed by said first feeding roller and said second feeding roller.

* * * * *

UNITED STATES PATENT AND TRADEMARK OFFICE

CERTIFICATE OF CORRECTION

PATENT NO. : 6,945,528 B2
APPLICATION NO. : 10/137373
DATED : September 20, 2005
INVENTOR(S) : Takao Nakamura It is certified that error appears in the above-identified patent and that said Letters Patent is hereby corrected as shown below:

COVER PAGE AT ITEM [56] RC:
Foreign Patent Documents, "57107346 A" should read --57-107346 A--; "01081721 A" should read --01-081721 A--; "01162640 A" should read --01-162640 A--; "03195635 A" should read --03-195635 A--; "06191650 A" should read --06-191650 A--; and "06234437 A" should read --06-234437 A--.

COLUMN 6:
Line 31, "so determined" should read --determined so--.
Line 59, "40c." should read --inner plate 40c.--

COLUMN 7:
Line 15, "at" should read --is at--.

COLUMN 8:
Line 44, "and" should be deleted.

Signed and Sealed this

Nineteenth Day of December, 2006

JON W. DUDAS
*Director of the United States Patent and Trademark Office*